United States Patent [19]

Guelck

[11] Patent Number: 4,674,777

[45] Date of Patent: Jun. 23, 1987

[54] CAM LOCK

[76] Inventor: Volker Guelck, 114 Columbia Street West, Waterloo, Ontario, Canada, N2L 3K8

[21] Appl. No.: 795,892

[22] Filed: Nov. 7, 1985

[51] Int. Cl.[4] ..... E05C 3/04

[52] U.S. Cl. ..... 292/101; 74/543; 292/241; 292/336.3; 292/DIG. 20; 292/DIG. 30

[58] Field of Search ..... 70/208; 292/336.3, DIG. 31, 292/DIG. 20, DIG. 63, 241, 202, DIG. 8, 95, 101, DIG. 30, DIG. 71, 240, 242, DIG. 12, DIG. 35, DIG. 47; 74/543

[56] References Cited

U.S. PATENT DOCUMENTS

| | | | |
|---|---|---|---|
| 621,600 | 3/1899 | Caldwell | 292/DIG. 31 X |
| 2,304,144 | 12/1942 | Borchers | 292/DIG. 31 X |
| 2,348,065 | 5/1944 | George | 292/DIG. 31 X |
| 2,423,937 | 7/1947 | Humer | 292/DIG. 31 X |
| 2,427,386 | 9/1947 | Claud-Mantle | 70/208 |
| 2,763,503 | 9/1956 | Tasch et al. | 292/DIG. 31 X |
| 2,767,008 | 10/1956 | Oswald | 292/241 |
| 3,020,075 | 2/1962 | Johnstone et al. | 292/DIG. 31 X |
| 3,153,553 | 10/1964 | Sandor | 292/336.3 |
| 3,797,870 | 3/1974 | Beckman | 292/DIG. 31 X |
| 3,993,339 | 11/1976 | Cherbourg et al. | 292/336.3 |
| 4,343,501 | 8/1982 | Meeks | 292/336.3 |

FOREIGN PATENT DOCUMENTS

| | | | |
|---|---|---|---|
| 1011716 | 4/1952 | France | 292/DIG. 71 |

*Primary Examiner*—Robert L. Wolfe
*Assistant Examiner*—Lloyd A. Gall
*Attorney, Agent, or Firm*—Daryl W. Schnurr

[57] ABSTRACT

A cam lock has a housing with a locking lever extending through an opening in said housing and being pivotally mounted thereon. The housing has a shoulder on an interior surface thereof surrounding said opening and the lever is surrounded by an abutment. In a closed position, the abutment forms a line of contact with the shoulder so that the opening is completely closed.

16 Claims, 3 Drawing Figures

CAM LOCK

BACKGROUND OF THE INVENTION

1. Field of the Invention

This invention relates to lock for a window and, in particular, to a cam lock that is used in conjunction with a keeper to lock a window.

2. Description of the Prior Art

Cam locks are usually used to lock casement windows. Existing cam locks have a locking lever with an elongated main body and engaging means at one end and a handle at the other end. The locking lever extends through an opening in a housing and the lever is pivoted within said opening. Since it is necessary for the lever to pivot relative to the housing, when the cam lock is in a closed position, there remains an airspace between said locking lever and said housing. In other words, the opening is not closed off and outside air can continue to enter a room, where the window is installed, even though the cam lock is in a closed position. In climates with cold winters, frost and ice has been known to form and build up on an interior surface of the housing and locking lever of existing cam locks. A serious ice build-up can cause the cam lock to be unworkable. Also, water formed as the ice melts can cause damage to the room or articles within the room. In addition, cold drafts from outside winds can make the interior of the room in the vicinity of the window uncomfortable. Further, the existing cam locks constitute an avoidable heat loss in buildings where they are installed.

SUMMARY OF THE INVENTION

It is an object of the present invention to provide a cam lock wherein the opening in a housing surrounding a locking lever is closed when the cam lock is in a closed position.

A cam lock for use with a keeper to lock a window has a housing with a suitable opening therein to receive an elongated locking lever. The lever has engaging means at an exterior end and a handle at an interior end. The housing has an interior surface surrounding said opening, with a shoulder located on said surface. An abutment substantially corresponding to said shoulder is located on said lever between said handle and said engaging means. The lever extends through said opening in said housing and is pivotally mounted relative to said housing about a pivot point so that, in a closed position, said lever being pivoted relative to said housing by means of said handle so that when said engaging means lockingly engages and cams said keeper, said abutment forms a line of contact with said shoulder, thereby closing said opening. In an open position, the lever is pivoted relative to the housing by means of said handle so that when said engaging means is out of contact with said keeper, said abutment is out of contact with said shoulder. In either position, said handle is located entirely on an interior side of said housing and said keeper is located on an exterior side of said housing.

Preferably, the shoulder completely surrounds said opening and the abutment completely surrounds said lever.

Further, a cam lock for use with a keeper to lock a window has an elongated locking lever. The locking lever has a body extending between engaging means formed on said lever at an exterior end and a handle formed on said lever at an interior end. A housing has a suitable opening to receive said lever. The housing has a shoulder on an interior surface thereof, said shoulder surrounding said opening. An abutment on said lever substantially corresponds to said shoulder. The lever extends through said opening in said housing and is pivotally mounted about a pivot point that is eccentrically located relative to said main body so that said lever can be pivoted relative to said housing from a closed position where said abutment and said shoulder form a line of contact when said engaging means lockingly engages and cams said keeper to an open position where said abutment and said shoulder are out of contact when said engaging means is out of contact with said keeper.

DESCRIPTION OF A PREFERRED EMBODIMENT

Figure 1:
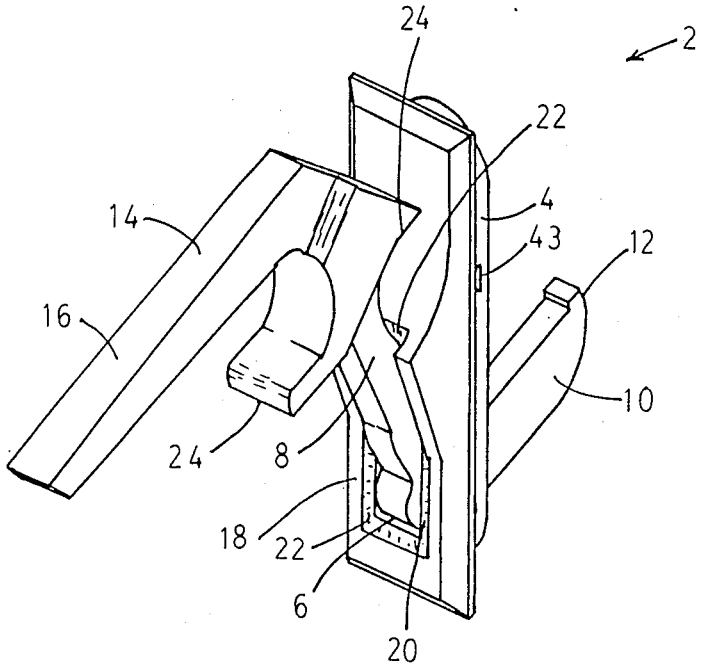
In FIG. 1, there is shown a perspective view of an interior side of a cam lock in an open position.

In FIG. 1, there is shown a cam lock 2 having a housing 4 with a suitable opening 6 therein to receive an elongated locking lever 8. The lever 8 has engaging means 10 at an exterior end 12 and a handle 14 at an interior end 16. The housing 4 has an interior surface 18 surrounding said opening 6 with a shoulder 20 located on said surface. The shoulder 20 also surrounds said opening 6 in the embodiment shown in FIG. 1. A seal 22 is located on said shoulder 20.

An abutment 24 substantially corresponding to said shoulder 20 is located on said lever 8.

Figure 2:
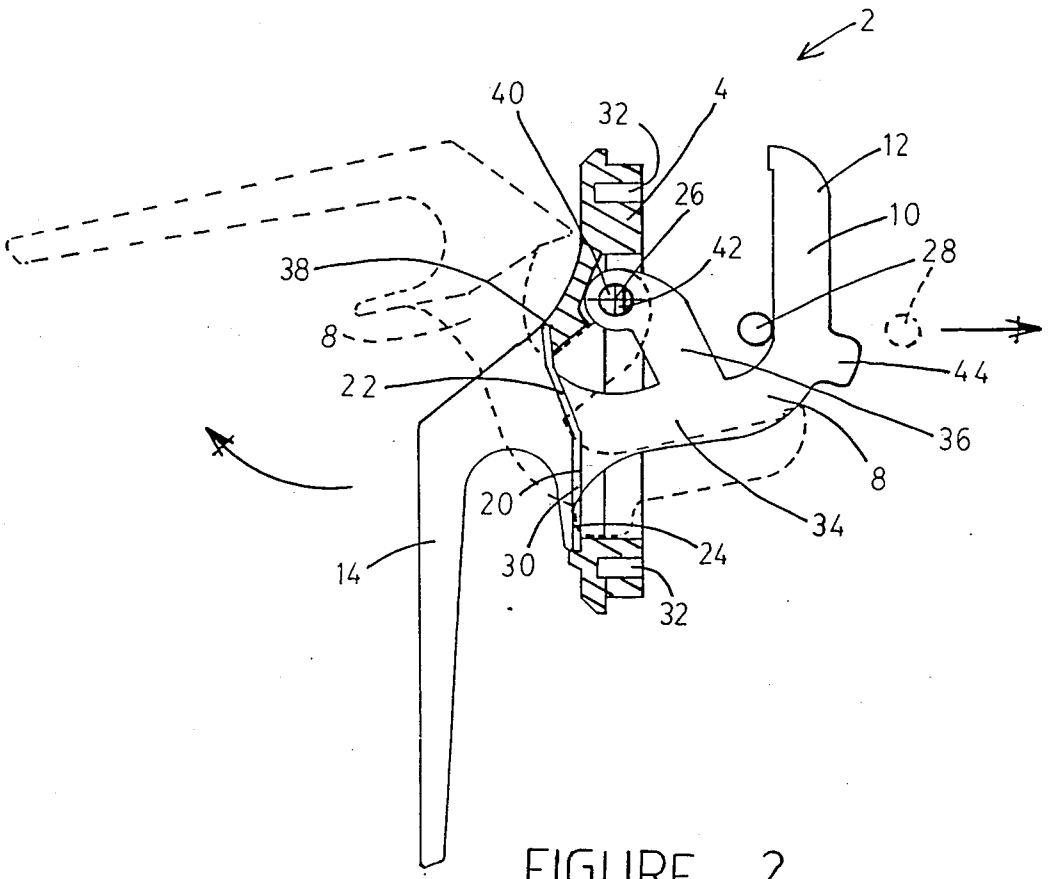
FIG. 2 is a partial sectional side view of a cam lock and keeper where a locking lever is shown in a closed position in solid lines and in an open position in dotted lines.

As can best be seen from FIG. 2, the lever 8 extends through said opening 6 and is pivotally mounted relative to said opening about a pivot point 26 located within said opening. The lever 8 is pivotally mounted so that in a closed position, as shown in solid lines in FIG. 2, the engaging means 10 lockingly engages a keeper 28 and said abutment 24 forms a line of contact 30 with said shoulder 20. Even though the housing 4 is shown in FIG. 2 as being partially cut away and partially in section, the shoulder 20 has been drawn into FIG. 2 and is shown as being located parallel to, but slightly apart from the abutment 24 for the following two reasons:

(a) so that the shoulder 20 and abutment 24 can be distinguished from one another; and (b) to accommodate the seal 22 that is located between the abutment 24 and the shoulder 20.

The seal 22 is located between the abutment 24 and the shoulder 20 and the locking lever is in a closed position, the line of contact between the abutment 24 and shoulder 20 is substantially airtight. In turn, the opening 6 is substantially airtight as it is closed off by the abutment meeting the shoulder. The seal 22 is preferably affixed to the shoulder 20 but could be affixed to the abutment 24. For the purposes of interpreting this specification, the abutment and shoulder shall still be considered to form a line of contact even though the abutment and shoulder are separated from one another by the seal. When the seal is present, the line of contact between the abutment and shoulder is formed along the seal. A particular advantage of locating the seal between the shoulder and abutment is that the seal will become tighter as greater pressure is exerted on the handle 14 in locking the cam lock.

In an open position, shown by the dotted lines of FIG. 2, the lever 8 is pivoted relative to the housing 4 so that said engaging means 10 is out of contact with said keeper 28 and said abutment 24 is out of contact with said shoulder 20. The keeper 28 is shown twice in FIG. 2, once using solid lines and once with dotted lines. The cam lock 2 is usually used with casement windows. The housing is mounted in the frame of the window by screws (not shown) that extend into channels 32 at either end of the housing 4. After the lever 8 is moved to the open position, the window can be opened by swinging it outwards, usually by turning an appropriate crank. As the window is opened, the keeper, which is mounted on the sash, moves further away from the frame (i.e. to the position shown by dotted lines in FIG. 2).

The opening 6 has an oblong shape and the shoulder 20 is preferably located in a depression that is shaped to receive said abutment 24 when the cam lock 2 is in the closed position. As can be seen from FIG. 2, the lever 8 is pivoted relative to the housing 6 so that the abutment 24 initially backs away from said shoulder 20 as the cam lock is being opened. The lever 8 has a main body 34 and the pivot point 26 is eccentrically located relative to said main body. An arm 36 extends between said main body 34 and said pivot point 26. An uppermost point 38 of the shoulder 20 is located at a level that is lower than the pivot point 26. In this way, the initial movement of the abutment 24 is to back away from the shoulder 20. If the uppermost point of the shoulder and therefore the corresponding point on the abutment where located at a level higher than the pivot point, the initial movement of the abutment would be towards the housing.

The pivot point 26 is a bar 40 that extends across the opening 6. The bar 40 has two ends 42, with either end being embedded in openings (not shown) in the housing 4. A hole (not shown) in the lever 8, through which the bar 40 extends, has a circular cross-section so that the lever 8 can pivot on said bar. The pivot pin 40 has a cross-section that is circular except that a segment of the circular cross-section is removed to create a flat side 43. The openings (not shown) in the housing 4 have a similar shape with a flat side so that the pivot pin 40 cannot rotate relative to said housing 4.

It can be seen in FIG. 2 that a lower half of the shoulder 20 and abutment 24 are parallel to and closer to an imaginary vertical plane through said pivot point 26 than an upper half of said shoulder 20 and abutment 24 which are located at an angle to and further away from said vertical plane.

A projection 44 is located on the lever 8. The projection 44 is long enough to contact the housing 4 when the cam lock is in a fully open position, thereby retaining said cam lock 2 in said open position. The projection 44 could be located elsewhere on said lever and holds the cam lock in an open position by friction. It can readily be seen that the locking lever is made from one piece, the housing is made from one piece and the pivot pin is made from one piece so that the entire cam lock is made of only three separate parts. This does not include the screws (not shown) that are located in the channels 32 to mount the device on a window frame.

Figure 3:
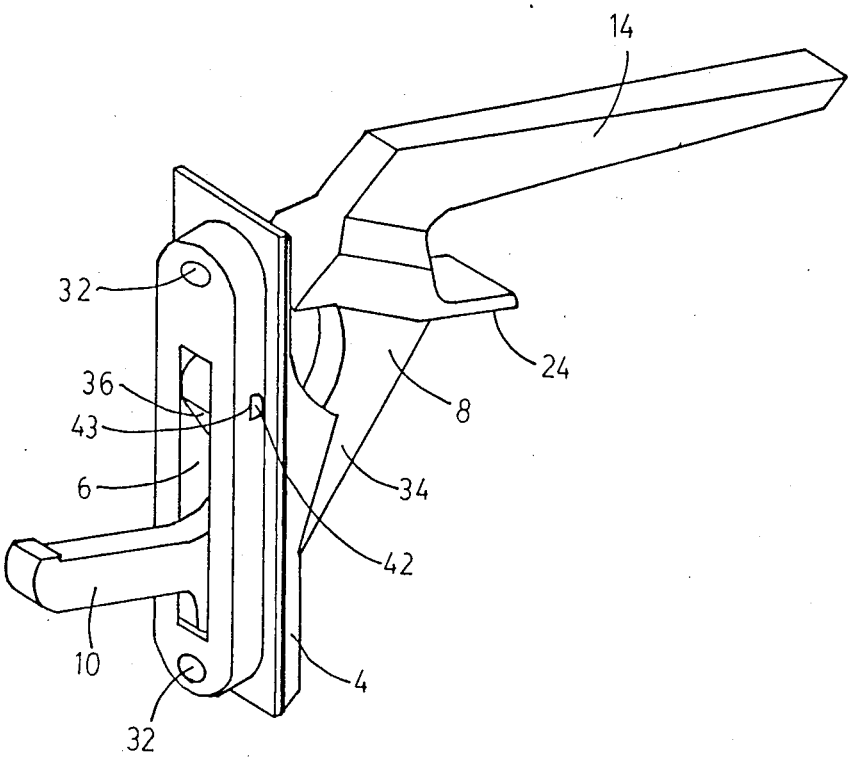
FIG. 3 is a perspective view of an exterior side of a cam lock in an open position.

From FIG. 3, an exterior side of the housing 4 can be seen and the shape of the opening 6 is revealed.

It will be noted that the cam lock is mounted relative to the keeper 28 so that the pivot point 26 is slightly above the level of the keeper. In this way, any force exerted on the keeper will tend to hold the cam lock in the closed position. If the keeper was located at a higher level than the pivot point, a force exerted on the keeper in a direction away from the housing would cause the cam lock to move toward the open position. This location of the keeper relative to the pivot point is considered conventional. The particular manner of mounting the cam lock in a window frame is not shown as that too is considered conventional. While any suitable materials can be used to make the cam lock of the present invention, preferably, the housing is plastic, and the handle and pivot pin are metal.

It will be readily apparent to those skilled in the art that numerous variations, within the scope of the attached claims, can be made in the shape and location of the housing and locking lever.

What I claim as my invention is:

1. A cam lock and keeper to lock a window, said cam lock comprising an elongated locking lever, said lever having a body extending between engaging means formed on said lever at an exterior end and a handle formed on said lever at an interior end, a housing having a suitable opening to receive said lever, said housing having a shoulder on an interior surface thereof, said shoulder surrounding said opening, with an abutment on said lever substantially corresponding to said shoulder, said lever extending through said opening in said housing and being pivotally mounted about a pivot point that is eccentrically located relative to said main body so that said lever can be pivoted relative to said housing from a closed position where said abutment and said shoulder form a line of contact when said engaging means lockingly engages and cams said keeper to an open position where said abutment and said shoulder are out of contact when said engaging means is out of contact with said keeper.

2. A cam lock as claimed in claim 1 wherein the pivot point is located within the opening.

3. A cam lock and keeper to lock a window, said cam lock comprising a housing with a suitable opening therein to receive an elongated locking lever, said lever having engaging means at an exterior end and a handle at an interior end, said housing having an interior surface surrounding said opening, with a shoulder located on said surface, an abutment substantially corresponding to said shoulder being located on said lever between said handle and said engaging means, said lever extending through said opening in said housing and being pivotally mounted relative to said housing about a pivot point so that:

(a) in a closed position, said lever is pivoted relative to said housing by means of said handle so that said engaging means lockingly engages and cams said keeper, and said abutment forms a line of contact with said shoulder, thereby closing said opening;

(b) in an open position, said lever is pivoted relative to said housing by means of said handle so that said engaging means is out of contact with said keeper, and said abutment is out of contact with said shoulder; and (c) in either position, said handle is located entirely on an interior side of said housing and said keeper is located on an exterior side of said housing.

4. A cam lock as claimed in claim 3 wherein the shoulder completely surrounds said opening and the abutment on said lever completely surrounds said lever.

5. A cam lock as claimed in claim 4 wherein the opening has an oblong shape and the shoulder is located in a depression that is shaped to receive said abutment when the cam lock is in a closed position.

6. A cam lock as claimed in claim 4 wherein the lever is pivoted so that the abutment initially backs away from said shoulder as the cam lock is being opened.

7. A cam lock as claimed in claim 6 wherein the lever has a main body and the pivot point is eccentrically located relative to said main body.

8. A cam lock as claimed in claim 7 wherein an arm of said lever extends between said main body and said pivot point.

9. A cam lock as claimed in claim 4 wherein the pivot point is a bar extending across said opening, said bar having two ends with either end being embedded in said housing, a hole in said lever, through which said bar extends, having a circular cross-section.

10. A cam lock as claimed in claim 9 wherein a pivot pin is located at said pivot point, said pivot pin extending between two suitable openings in said housing and having a cross-section that is circular except that a segment of said circular cross-section is removed to create a flat side, the openings in the housing having a similar shape with a flat side so that the pivot pin cannot rotate relative to said housing.

11. A cam lock as claimed in claim 9 wherein said cam lock is made of only three separate parts, the housing, the lever and a pivot pin located at said pivot point.

12. A cam lock as claimed in any one of claims 3, 4 or 5 wherein there is a seal located between said abutment and said shoulder when said cam lock is in a closed position so that the line of contact between the abutment and shoulder is substantially airtight.

13. A cam lock as claimed in any one of claims 3, 4 or 5 wherein the pivot point is located within said opening.

14. A cam lock as claimed in any one of claims 3, 4 or 5 wherein, when the cam lock is installed vertically in a window, an uppermost point of said shoulder is located at a level that is lower than said pivot point.

15. A cam lock as claimed in any one of claims 3, 4 or 5 wherein, when the cam lock is oriented in a vertical position in a window, a lower half of said shoulder and abutment are parallel to and closer to a vertical plane through said pivot point than an upper half of said shoulder and abutment which are located at an angle to and further away from said vertical plane.

16. A cam lock as claimed in any one of claims 3, 4 or 5 wherein there is a projection located on said lever, said projection being long enough to contact said housing when said cam lock is in a fully open position, thereby retaining said cam lock in said open position.

* * * * *